US010084232B1

(12) United States Patent
Sayem et al.

(10) Patent No.: US 10,084,232 B1
(45) Date of Patent: Sep. 25, 2018

(54) AUXILIARY ELECTRONIC ELEMENT, WIRELESS COMMUNICATION DEVICE, AND METHOD FOR MANAGING THE LENGTH OF A SET OF ONE OR MORE CONDUCTORS

(71) Applicant: Motorola Mobility LLC, Chicago, IL (US)

(72) Inventors: Abu Sayem, Overland Park, KS (US); Eric Krenz, Crystal Lake, IL (US)

(73) Assignee: Motorola Mobility LLC, Chicago, IL (US)

( * ) Notice: Subject to any disclaimer, the term of this patent is extended or adjusted under 35 U.S.C. 154(b) by 0 days.

(21) Appl. No.: 15/652,988

(22) Filed: Jul. 18, 2017

(51) Int. Cl.

| | |
|---|---|
| ***H01Q 1/52*** | (2006.01) |
| ***H01Q 21/06*** | (2006.01) |
| ***H01Q 5/392*** | (2015.01) |
| ***H01Q 5/321*** | (2015.01) |
| ***H01Q 1/24*** | (2006.01) |

(52) U.S. Cl.
CPC ..... *H01Q 1/521* (2013.01); *H01Q 1/243* (2013.01); *H01Q 5/321* (2015.01); *H01Q 5/392* (2015.01); *H01Q 21/065* (2013.01)

(58) Field of Classification Search
CPC ..... H01Q 1/521; H01Q 5/321; H01Q 5/392; H01Q 1/243; H01Q 21/065
USPC ..... 343/844
See application file for complete search history.

(56) References Cited

U.S. PATENT DOCUMENTS 6,657,595 B1 * 12/2003 Phillips ..... H01Q 1/245 343/702

* cited by examiner

*Primary Examiner* — Andrea Lindgren Baltzell
(74) *Attorney, Agent, or Firm* — Watson Intellectual Property Group

(57) ABSTRACT

The present application is directed to managing the length of a set of one or more conductors in an auxiliary electronic element, which is coupled to a wireless communication device. The auxiliary electronic element includes the set of one or more conductors coupled to and extending away from main internal electronic circuitry of the auxiliary electronic element, the main internal electronic circuitry supporting and controlling at least some of the operation of the auxiliary electronic element. The set of one or more conductors extends through an area proximate to at least one of one or more antennas of the wireless communication device a predetermined adjusted length away from the main internal electronic circuitry, in which the at least one of one or more antennas of the wireless communication device supports a wireless communication connection with another wireless communication device. The predetermined adjusted length of the set of one or more conductors is selected so as to match a one quarter length of a longest wavelength of one or more frequencies of the wireless communication connection associated with the at least one of the one or more antennas, which are affected by the set of one or more conductors of the auxiliary electronic element extending through the area proximate thereto.

20 Claims, 5 Drawing Sheets

AUXILIARY ELECTRONIC ELEMENT, WIRELESS COMMUNICATION DEVICE, AND METHOD FOR MANAGING THE LENGTH OF A SET OF ONE OR MORE CONDUCTORS

FIELD OF THE APPLICATION

The present application relates generally to managing the use of an auxiliary electronic element with a wireless communication device, and more particularly, to managing the length of the set of one or more conductors of an auxiliary electronic element that extends through an area proximate to at least one of one or more antennas of the wireless communication device, when the auxiliary electronic element is coupled to the wireless communication device.

BACKGROUND

During the recent past, wireless communication devices including cellular telephones have transitioned from communication devices dedicated to making a wireless voice call, to multifunction devices capable of voice communications, data communications and web access. Wireless communication devices have generally become increasingly more capable, with the newer devices generally continuing to incorporate more and more functionality. However, it is not always practical to incorporate every possible feature into a device, that one or more of its many users may find beneficial to include and have be present in the device. This can be the case, where use of the feature may be infrequent, and/or the space requirements in connection with the additional features, when considered in connection to the frequency of use, may not justify a permanent presence in the device.

In some instances, a particular feature can be supported through the use of a peripheral, which can be selectively coupled to the main device as needed. By being implemented as a peripheral, as opposed to a separate stand alone device, one can leverage the processing, storage and communication capabilities of the main device, so as to more selectively implement the additional features with the device, while still leveraging the synergistic benefits associated with including the additional features as part of a coupled peripheral for use with the main device.

Incorporating the feature into a peripheral, allows those users that want to make use of the particular feature to be able to choose to acquire the peripheral. Furthermore, the peripheral and features which they support could then be alternatively separated from and correspondingly selectively paired with the device, so as to correspond to only those instances in which the features the peripheral supports are needed or desired. In at least some instances, examples of features that one or more peripherals can support include extended image capture, audio projection, power storage, and/or image projection capabilities. However a device peripheral pairing generally involves the need to be able to share data between the two elements, which can often involve a physical coupling of the two elements. When the two elements are physically coupled, various aspects of one of the elements can sometimes be brought into physical proximity to various aspects of the other element. For example, a conductor such as a flex circuit with one or more traces in one of the elements could be brought into proximity of one or more antennas, which are supporting wireless communications relative to the other element. In at least some instances, this has the potential to produce a degradation and/or a parasitic effect relative to the functioning of the antenna in support of the wireless communications. More specifically, the conductor being brought into proximity of the one or more antennas can cause an impedance detune and/or an undesired or alternative path for energy dissipation of a wireless signal.

The present inventors have recognized that the nature of any degradation and/or parasitic effect can be a function of the geometry of the conductor that is being brought into proximity of the one or more antennas. By managing the geometry of the conductor, the degradation and/or parasitic effect can be reduced and/or better controlled.

SUMMARY

The present application provides an auxiliary electronic element for coupling to a wireless communication device. The auxiliary electronic element includes main internal electronic circuitry for supporting and controlling at least some of the operation of the auxiliary electronic element. The auxiliary electronic element further includes a set of one or more conductors coupled to and extending away from the main internal electronic circuitry of the auxiliary electronic element. The set of one or more conductors extends through an area proximate to at least one of one or more antennas of the wireless communication device a predetermined adjusted length away from the main internal electronic circuitry, when the auxiliary electronic device is coupled to the wireless communication device in which the at least one of one or more antennas of the wireless communication device supports a wireless communication connection with another wireless communication device. The predetermined adjusted length of the set of one or more conductors is selected so as to match a one quarter length of a longest wavelength of one or more frequencies of the wireless communication connection associated with the at least one of the one or more antennas, which are affected by the set of one or more conductors of the auxiliary electronic element extending through the area proximate thereto.

In at least some instances, the one or more frequencies of the wireless communication connection associated with the at least one of the one or more antennas, which are affected by the set of one or more conductors, include at least a pair of affected frequencies. A shortest wavelength of the at least pair of affected frequencies is used to determine a location of a ground connection for the set of one or more conductors, where the location of the ground connection is one quarter of the wavelength of the shortest wavelength measured from the area proximate to the at least one of the one or more antennas through which the set of one or more conductors extends, toward the coupled end associated with the internal electronic circuitry. The ground connection is made via a selective signal frequency shorting circuit, which is tuned to the frequency from the at least pair of affected frequencies having the shortest wavelength.

In at least some further instances, the one or more frequencies of the wireless communication connection associated with the at least one of the one or more antennas, which are affected by the set of one or more conductors, include at least a pair of affected frequencies in addition to the affected frequency having the longest wavelength. Each of the shorter wavelengths of the at least pair of additional affected frequencies is used to determine a respective location of a ground connection for the set of one or more conductors. The respective locations of the ground connections are each one quarter of the wavelength of the respective additional affected frequencies measured from the area proximate to the at least one of the one or more antennas through which the set of one or more conductors extends, toward the coupled end associated with the internal electronic circuitry. The ground connections are made via respective selective signal frequency shorting circuits, each tuned to the corresponding respective additional affected frequency.

The present application further provides a method for managing the length of the set of one or more conductors, in an auxiliary electronic element for selectively coupling to a wireless communication device, where the auxiliary electronic element includes main internal circuitry and a set of one or more conductors extending from the main internal circuitry. The set of one or more conductors also extends through an area proximate to at least one of one or more antennas of the wireless communication device, when the auxiliary electronic element is coupled to the wireless communication device. The method includes identifying one or more frequencies of a wireless communication connection associated with the at least one of the one or more antennas that are affected by the set of one or more conductors extending through an area proximate to the at least one of the one or more antennas. A quarter wavelength of the affected one or more frequencies having the longest wavelength is determined. The length of the set of one or more conductors is adjusted, such that the distance between the area proximate to the at least one of the one or more antennas through which the set of one or more conductors extends there through and the connection to the main internal circuitry is equivalent to the determined quarter wavelength.

The present application still further provides a wireless communication device. The wireless communication device includes one or more antennas for supporting a wireless communication connection with one or more other wireless communication devices via at least one of transmitter circuitry and receiver circuitry. The wireless communication device further includes an electrical connection port located at a point along an external surface of the wireless communication device, the electrical connection port for selectively coupling to an auxiliary electronic element. The wireless communication device still further includes a coupled auxiliary electronic element. The coupled auxiliary electronic element includes main internal electronic circuitry for supporting and controlling at least some of the operation of the coupled auxiliary electronic element. The coupled auxiliary electronic element further includes a set of one or more conductors coupled to and extending away from the main internal electronic circuitry of the coupled auxiliary electronic element, where the set of one or more conductors extends through an area proximate to at least one of the one or more antennas of the wireless communication device a predetermined adjusted length away from the main internal electronic circuitry. The predetermined adjusted length of the set of one or more conductors is selected so as to match a one quarter length of a longest wavelength of one or more frequencies of the wireless communication connection associated with the at least one of the one or more antennas, which are affected by the set of one or more conductors of the auxiliary electronic element extending through the area proximate thereto.

These and other objects, features, and advantages of the present application are evident from the following description of one or more preferred embodiments, with reference to the accompanying drawings.

DETAILED DESCRIPTION OF THE PREFERRED EMBODIMENT(S)

Figure 2:
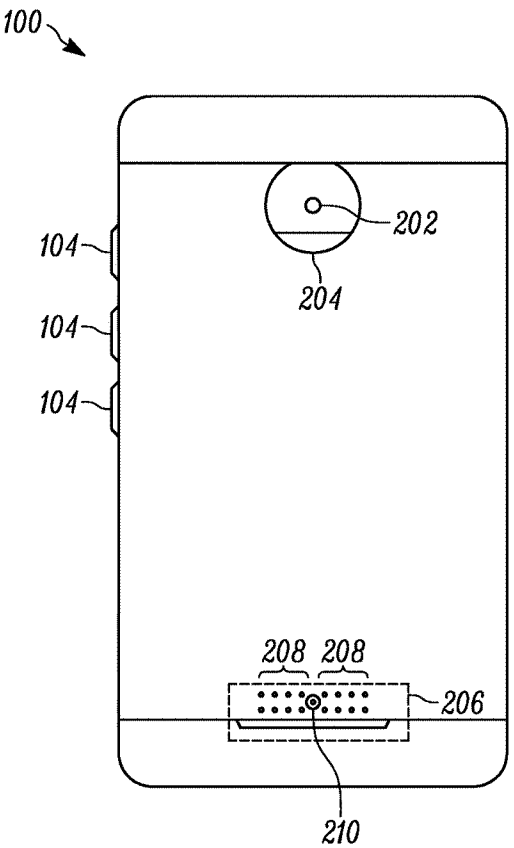
FIG. 2 is a back view of an exemplary wireless communication device.

While the present application is susceptible of embodiment in various forms, there is shown in the drawings and will hereinafter be described presently preferred embodiments with the understanding that the present disclosure is to be considered an exemplification and is not intended to be limited to the specific embodiments illustrated.

Figure 1:
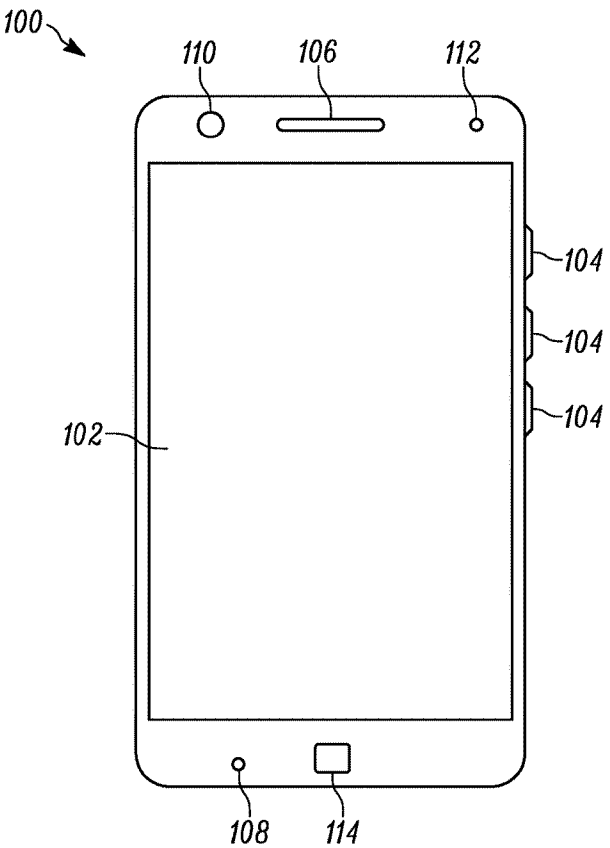
FIG. 1 is a front view of an exemplary wireless communication device.

FIG. 1 illustrates a front view of an exemplary wireless communication device 100. While in the illustrated embodiment, the type of wireless communication device shown is a radio frequency cellular telephone, which includes a wireless communication interface for supporting wireless communications with one or more other wireless communication devices, and includes an interface for coupling an auxiliary electronic element, such as a peripheral and/or an accessory, to the wireless communication device, other types of devices that include wireless radio frequency communication and an ability to be used with an auxiliary electronic element are also relevant to the present application. In other words, the present application is generally applicable to wireless communication devices beyond the type being specifically shown. A couple of additional examples of suitable wireless communication devices that may additionally be relevant to the present application in the management of the features of a auxiliary electronic element coupled to the wireless communication device can include a tablet, a laptop computer, a desktop computer, a netbook, a cordless telephone, a selective call receiver, a gaming device, a personal digital assistant, as well as any other form of wireless communication device that may include the use of one or more auxiliary electronic elements, such as a peripheral.

In the illustrated embodiment, the wireless communication device 100 includes a display 102 which covers a large portion of the front facing. In at least some instances, the display can incorporate a touch sensitive matrix, that can help facilitate the detection of one or more user inputs relative to at least some portions of the display, including an interaction with visual elements being presented to the user via the display 102. In some instances, the visual element could be an object with which the user can interact. In other instances, the visual element can form part of a visual representation of a keyboard including one or more virtual keys and/or one or more buttons with which the user can interact and/or select for a simulated actuation. In addition to one or more virtual user actuatable buttons or keys, the device 100 can include one or more physical user actuatable buttons 104. In the particular embodiment illustrated, the device has three such buttons located along the right side of the device.

The exemplary wireless communication device 100, illustrated in FIG. 1, additionally includes a speaker 106 and a microphone 108 in support of voice communications. The speaker 106 may additionally support the reproduction of an audio signal, which could be a stand-alone signal, such as for use in the playing of music, or can be part of a multimedia presentation, such as for use in the playing of a movie, which might have at least an audio as well as a visual component. The speaker may also include the capability to also produce a vibratory effect. However, in some instances, the purposeful production of vibrational effects may be associated with a separate element, not shown, which is internal to the device. Generally, the speaker 106 is located toward the top of the device 100, which corresponds to an orientation consistent with the respective portion of the device facing in an upward direction during usage in support of a voice communication. In such an instance, the speaker 106 might be intended to align with the ear of the user, and the microphone 108 might be intended to align with the mouth of the user. Also located near the top of the device, in the illustrated embodiment, is a front facing camera 110, and a corresponding flash 112. In the illustrated embodiment, the wireless communication device 100 further includes a fingerprint sensor 114.

FIG. 2 illustrates a back view of the exemplary wireless communication device 100, illustrated in FIG. 1. In the back view of the exemplary wireless communication device, the three physical user actuatable buttons 104, which are visible in the front view, can similarly be seen. The exemplary wireless communication device additionally includes a back side facing camera 202 with a flash 204, as well as an electrical connection port 206. In the illustrated embodiment, the electrical connection port 206 includes multiple conductive elements, which are intended to connect with corresponding structure in another device, such as a peripheral and/or an accessory, that can be brought within proximity and/or in contact with the other device. More specifically, in the illustrated embodiment, the electrical connection port 206 can include conductive pins or ports 208 that allow individual signals to be conveyed electronically through a corresponding coupling to another device 400 having corresponding structure 406, illustrated in FIG. 4. The electrical connection port 206 can additionally include still further structure 210, such as a registration pin, that would support proper alignment with the corresponding structure 406 of the other device 400. The peripheral communication interface 206 is generally adapted for conveying electrical signals, which can include data and/or power signals.

While a particular electrical connection port 206 is illustrated, one skilled in the art will appreciate that the electrical connection port can take alternative and/or still further forms via which data and/or power signals can be conveyed between an auxiliary electronic element and a base device. In at least some instances, the structure that can support such an interface can include forms which are compatible with various industry standards, such as Universal Serial Bus (USB), Peripheral Component Interconnect Express (PCIE), Subscriber Identity Module (SIM), etc., type standards and/or interfaces. Additionally, the data interface could take the form of a non-contacting interface, like an optical or a wireless link.

Figure 3:
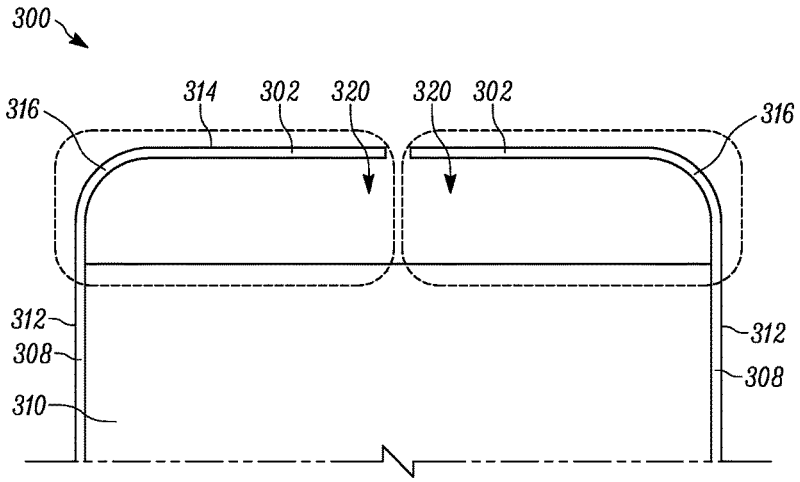
FIG. 3 is a partial internal view of the exemplary wireless communication device, which illustrates one potential form of one or more antennas.

FIG. 3 illustrates a partial internal view 300 of the exemplary wireless communication device 100, which illustrates one potential form of one or more antennas 302. In the illustrated embodiment, the particular antennas 302 which are featured can include antennas that are formed as part of a conductive housing. More specifically, in the particular embodiment illustrated, the one or more antennas 302 can be integrated as part of a sidewall 308 of the device 100, made from a conductive material, which extends from a substrate 310 and around the outer periphery of the device. The substrate 310 could be part of the housing and/or internal to the device 100. In at least some instances where the substrate is internal to the device 100, the substrate could include a circuit substrate, such as a printed circuit board, upon which various circuitry and connecting conductive traces could be formed. The one or more antennas 302, illustrated, includes a pair of antennas, which each extend from a respective side edge 312 of the housing toward the top edge 314 of the device, forming respective arms. Each arm turns forming a respective corner 316 proximate to the top edge 314 of the device and continues along the top edge toward the center of the top edge and the extending arm of the other antenna 302. In the illustrated embodiment, the respective arms 302 stop short of touching or overlapping one another.

In the illustrated embodiment, the one or more antennas 302 are intended to radiate and/or receive energy associated with a wireless signal. In connection with radiating and/or receiving energy associated with a wireless signal, an area proximate to each of the antennas can be identified and designated as a keep out area 320 in which the placement of other conductive elements are avoided, and/or to the extent that other conductive elements are present, consideration is given in an attempt to minimize any adverse effect the conductive elements might have on the ability of the antenna(s) to receive or radiate the corresponding energy associated with a desired wireless signal. In the illustrated embodiment, a keep out area 320 has generally been included within the area enclosed by the dashed lines.

Figure 4:
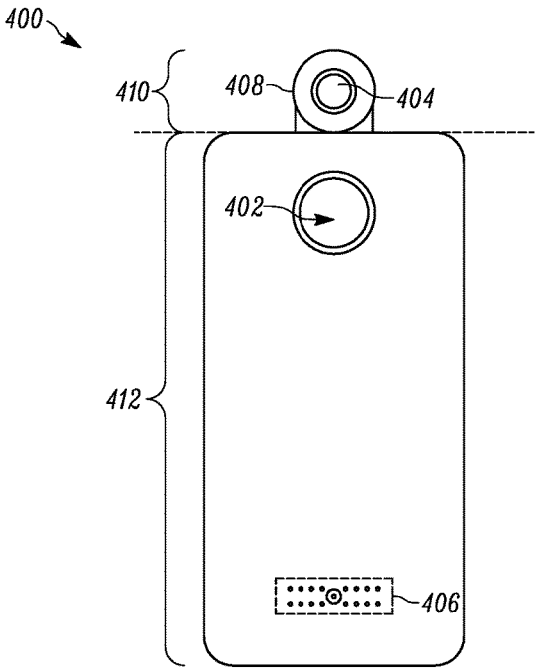
FIG. 4 is a back view of an exemplary auxiliary electronic element.

FIG. 4 illustrates a back view of an exemplary auxiliary electronic element 400, which could be used in connection with a wireless communication device 100, such as the one illustrated in FIGS. 1 and 2, in order to provide an extension of capabilities that can be used in conjunction with the wireless communication device 100, to which it is associated and/or attached. As noted previously, because a auxiliary electronic element 400, such as a peripheral, can be selectively associated with and/or attached to another device, the auxiliary electronic element may offer opportunities to customize the use of a wireless device in instance where and when the extended capabilities provided by the auxiliary electronic element are desired. In at least some instances, examples of extended features that one or more auxiliary electronic elements can have include enhanced image capture, audio projection, power storage and/or image projection capabilities.

In some cases, the form factor for a particular auxiliary electronic element can take into account the structural details of the device(s) to which it is intended to be attached, and/or with which it is intended to be used. For example, in the illustrated embodiment, the auxiliary electronic element 400 has a size and shape, which generally conforms to the overall size of the back side of the wireless communication device 100, which is illustrated in FIG. 2. The auxiliary electronic element 400 even includes a circular opening 402, which is sized and positioned, so as to coincide with the proximate position of the combination rear facing camera 202 and flash 204 of the wireless communication device 100, such that when the wireless communication device 100 and the auxiliary electronic element 400 are brought together, there will not be an obstruction of the combination camera 202 and flash 204 located on the back side surface of the device 100.

In the particular embodiment illustrated, the auxiliary electronic element 400 is intended to provide the extended feature of enhanced image capture. More specifically, the particular auxiliary electronic element illustrated provides the use of additional and/or alternative image capture element(s) 404, which can be incorporated as part of a 360 degree camera 408. Images captured from multiple image capture elements 404 can be stitched together to provide a larger image.

While the auxiliary electronic element 400 has a size and shape, which generally conforms to the overall size of the back side of the wireless communication device 100, in the illustrated embodiment, the auxiliary electronic element 400 has a section 410 including additional electronic circuitry 502 that can extend beyond section 412, which corresponds to the outline of the wireless communication device 100. In the present instance, the additional electronic circuitry 502 can include at least some aspects of the 360 degree camera 408. The additional electronic circuitry 502 can be separate from any main internal electronic circuitry 504 of the auxiliary electronic element 400, which can be alternatively generally positioned within the section 412 of the auxiliary electronic element 400 having a size and shape that coincides with the general outline of the wireless communication device 100. The additional electronic circuitry 502 is generally coupled to the main internal electronic circuitry 504 via a set of one or more conductors 508, that can take the form of a flex circuit. In at least some instances, the set of one or more conductors 508 can extend through a keep out area 320 associated with one or more antennas 302, such as when the auxiliary electronic element 400 might be coupled to the wireless communication device 100.

Figure 5:
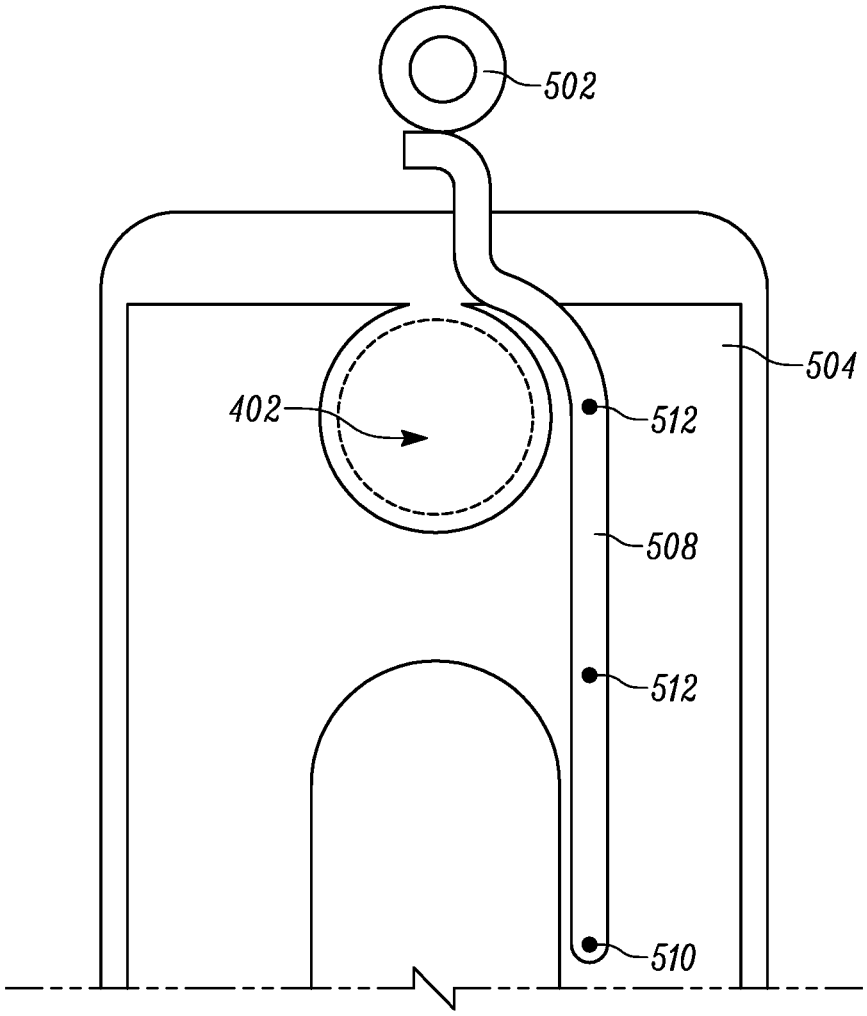
FIG. 5 is a partial internal view of the exemplary auxiliary electronic element, which includes a set of one or more conductors extending from main internal electronic circuitry and which can extend through an area proximate to the at least one of the one or more antennas of the wireless communication device.

FIG. 5 illustrates a partial internal view 500 of the exemplary auxiliary electronic element 400, which includes a set of one or more conductors 408 extending from main internal electronic circuitry 504 and which would extend through an area 320 proximate to the at least one of the one or more antennas 302 of the wireless communication device 100, when the exemplary auxiliary electronic element 400 is coupled to the wireless communication device 100. In addition to extending through a keep out area 320 relative to the one or more antennas 302, the set of one or more conductors 408 might also be routed around other elements, such as structural impediments like the opening 402 in the auxiliary electronic element 400, which allows the camera 202 on the back side surface of the exemplary wireless communication device 100 to avoid being covered.

By being routed through the area proximate to the one or more antennas 302, the radiation and receipt of energy by the one or more antennas 302 can be affected at one or more frequencies, that may be of interest. However, the effect at the one or more affected frequencies of interest can be adjusted and correspondingly reduced, if the geometries of the set of one or more conductors 508 are managed in a way so as to limit the amount of energy at the affected frequencies that can couple to the set of one or more conductors 508 as the conductor passes through the area of interest. More specifically, the present inventors have recognized that the overall length of the one or more conductors after passing through the keep out area 320 can be controlled so as to manage the apparent impedance of the set of one or more conductors 508 at one of the affected frequencies, so as to effectively detune and/or decouple the set of one or more conductors 508 from any energy having the corresponding affected frequency in and/or proximate to the keep out area 320, where it is more likely to have an adverse effect on the radiation and receipt of energy by the one or more antennas 302. By controlling the length of the set of one or more conductors 508, so as to be approximately one quarter the wavelength of the smallest frequency of interest having the longest wavelength, an effective impedance for the set of one or more conductors 508 that might otherwise more strongly couple to nearby energy being proximate in frequency to the smallest frequency of interest changes so as to more weakly couple to any energy proximate in frequency to the smallest frequency of interest that might be present.

In other words, the point of interaction of the conductor proximate the open end of the flex that is closer to the keep out area has the potential to electromagnetically couple to the antenna and receive electromagnetic energy, therefrom. However, a conductor having a length corresponding to a quarter wavelength away from the point of interaction will influence the interaction between the conductor and the antenna, so as to appear closer to an open circuit and/or a circuit of a relatively higher impedance at the corresponding frequency associated with the quarter wavelength distance. Since the flex is making a connection to the printed circuit board at a distance of a quarter wavelength from the point of interaction, at the point of interaction the connection point to the printed circuit board becomes a relatively higher impedance connection point rather than a lower impedance connection point and/or short circuit at the corresponding frequency of interest. Hence the electromagnetic energy received by the conductor from the antenna through the point of interaction at the frequency corresponding to the quarter wavelength distance will not be going to the printed circuit board, and correspondingly the amount of detuning that could result from such an interaction can be reduced and/or minimized.

Point 510 represents the end lengthwise of the set of one or more conductors 508, and is the point where the set of one or more conductors 508 are coupled to the main internal electronic circuitry 504, such as the electronic circuitry which can be printed and mounted as part of a printed circuit board. Still further affected frequencies of interest can be adjusted through selective signal frequency shorting circuits coupled to the set of one or more conductors 508 at still further distances 512 along its length corresponding to one quarter of the wavelength of the additional frequencies of interest, where the respective selective signal frequency shorting circuits 602 are tuned to provide a short to ground at the respective frequency of interest. An electrical short one quarter of a wavelength away from the keep out area 320 for signals having a particular frequency would appear as an open circuit for signals having the particular frequency proximate to the keep out area 320.

Figure 6:
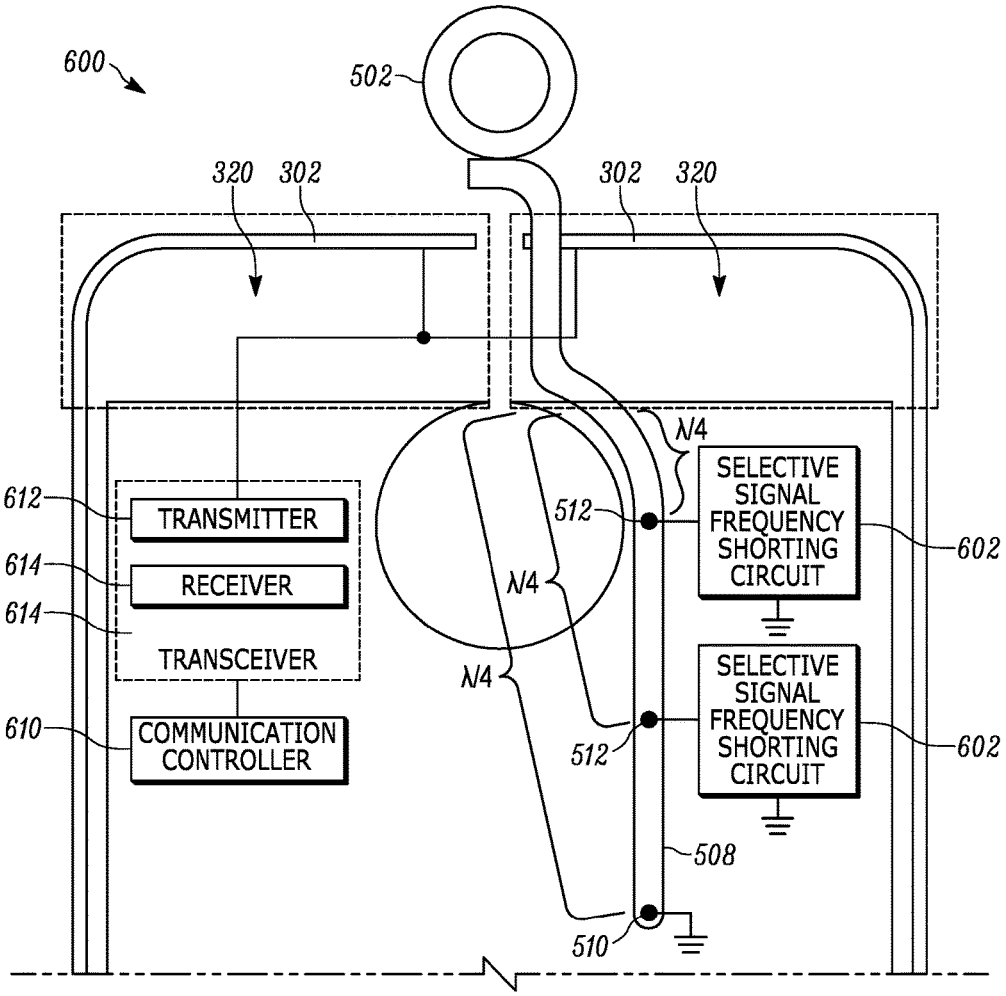
FIG. 6 is a partial overlay view highlighting the interaction between the internal elements of the exemplary wireless communication device and the internal elements of the exemplary auxiliary electronic element.

FIG. 6 illustrates a partial overlay view 600 highlighting the interaction between the internal elements of the exemplary wireless communication device 100 and the internal elements of the exemplary auxiliary electronic element 400. More specifically, in the illustrated embodiment three frequencies of interest are accommodated, where the smallest frequency having the longest wavelength is used to determine an overall length of the set of one or more conductors, which is one quarter of the longest wavelength for the affected frequencies of interest, measured from the area proximate to the one or more antennas 302. Respective signal frequency shorting circuits are each associated with the other frequencies of interest, where the respective selective signal frequency shorting circuits 602 are tuned to the corresponding frequency of interest and are coupled to the set of one or more conductors 508 a distance away from the area proximate to the one or more antennas 302, which is approximately a quarter wavelength of the corresponding respective frequency.

While the exemplary embodiment accommodates three affected frequencies, one skilled in the art will recognize that a different number of affected frequencies can be accommodated with a larger or smaller number of selective signal frequency shorting circuits 602. Generally, a first frequency of interest corresponding to the frequency having the longest wavelength can be accommodated by controlling the overall length of the set of one or more conductors 508. Each additional affected frequency can be accommodated using a respective selective signal frequency shorting circuit 602, which is coupled to the set of one or more conductors 508 at the appropriate corresponding quarter wavelength distance.

FIG. 6 further illustrates a communication controller 610, which is included as part of the wireless communication device 100, that is coupled to the one or more antennas 302 via a transmitter 612 and/or a receiver 614, which can take the form of a transceiver 616. Together, the communication controller 610; the transmitter 612, receiver 614 and/or transceiver 616; and the one or more antennas can be used to support wireless communications with another wireless communication device. The communication controller 610 can be implemented in various combinations of hardware and/or software using one or more of discrete logic elements, state machines, gate arrays, processors, firmware, as well as one or more sets of pre-stored instructions stored in the one or more respective data storage modules to be executed by a corresponding processor and/or controller.

In at least some instances, the wireless communication device 100 will communicate directly with the intended target of its wireless communication. In other instances, the wireless communication device 100 will communicate with the intended target of its wireless communication via network infrastructure, such as an exemplary network environment. The exemplary network environment can include one or more base stations, as well as further supporting infrastructure, which can form all or parts of a wireless network.

In at least some instances, such a wireless network can include various public, private and personal networks, packet data and/or circuit switched networks, as well as various wide-area and local-area networks. More specifically, in at least some instances, the wireless network can be used to support one or more forms of cellular communications, where access to the network can be supported through the one or more base stations, which may each be used to support wireless network access relative to a particular geographical area. Where the intended target of the wireless communication is another wireless communication device, connection to the wireless network for the other wireless communication device may be supported by the same or a different base station.

The various communication connections between the different devices and/or network elements can additionally involve one or more different communication standards. At least a couple of examples of different communication standards include Global System for Mobile Communications (GSM) Code Division Multiple Access (CDMA), Orthogonal Frequency Division Multiple Access (OFDMA), Long Term Evolution (LTE), Global Positioning System (GPS), Bluetooth®, Wi-Fi (IEEE 802.11), Near Field Communication (NFC), Internet/Intranet (TCP/IP), Internet of Things (IOT), as well as various other communication standards. In addition, the wireless communication device 100 may utilize a number of various additional forms of communication including systems and protocols that support a communication diversity scheme, as well as carrier aggregation and simultaneous voice and data signal propagation.

Figure 7:
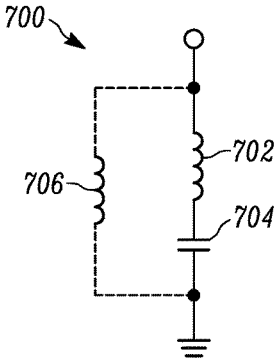
FIG. 7 is a schematic view of an exemplary selective signal frequency shorting circuit.

FIG. 7 is a schematic view 700 of an exemplary selective signal frequency shorting circuit 602. In at least some instances, the selective signal frequency shorting circuit 602 will include an inductor capacitor series resonant circuit, which can be tuned to allow only certain frequencies to pass. For example, the circuit will appear to be a short and/or low impedance circuit for a certain band of frequencies, and will appear to be an open and/or high impedance circuit for other frequencies. Such a circuit can include an inductor 702 in series with a capacitor 704. In some instances a further inductor 706 can be coupled in parallel with the series combination of the inductor 702 and the capacitor 704. The values of the components can be selected so as to control, which frequencies are selectively blocked and/or are allowed is to pass.

In addition to the inductor capacitor series resonant circuit, illustrated in FIG. 7, still further types of circuits may be used to support the selective signal frequency shorting. For example, an open transmission line stub could be alternatively and/or additionally be used, as well as a coax resonator, or various other types of filters.

Figure 8:
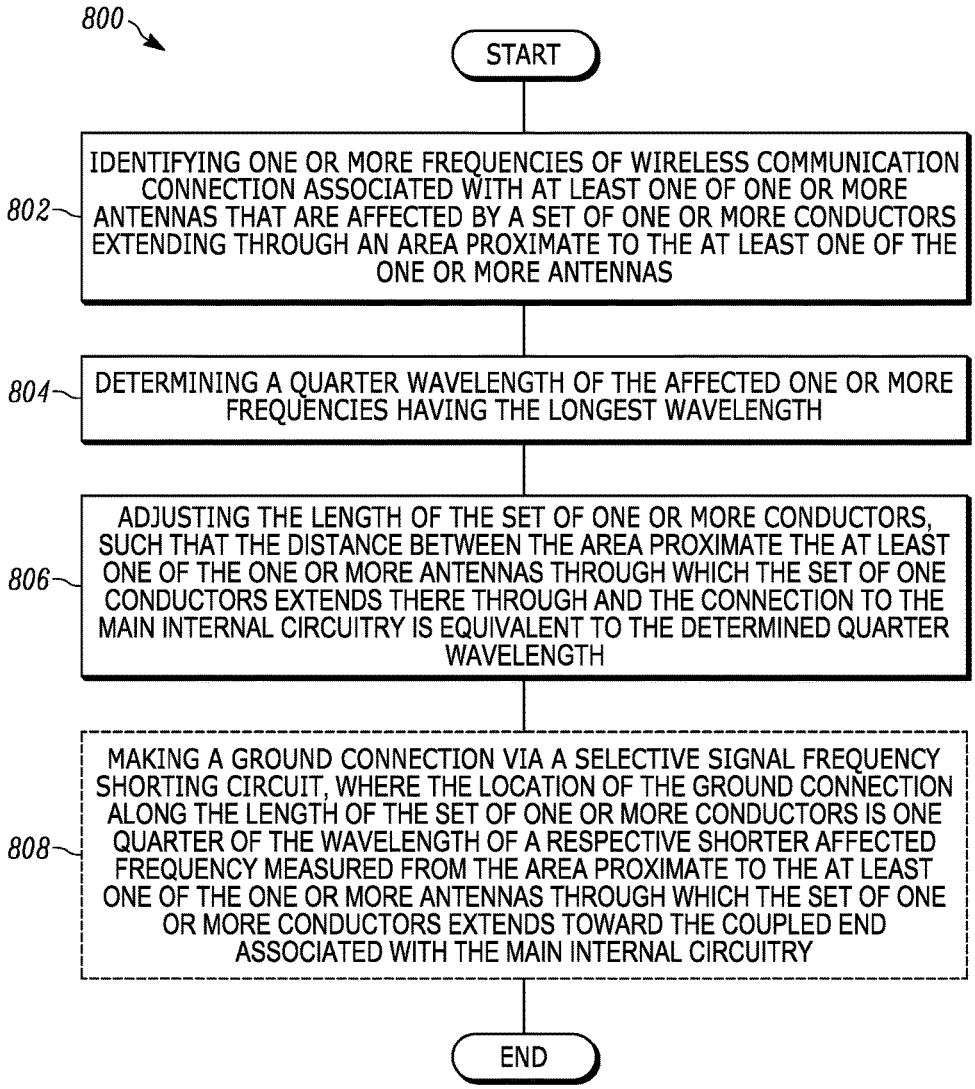
FIG. 8 is a flow diagram of a method for managing the length of a set of one or more conductors.

FIG. 8 illustrates a flow diagram of a method 800 for managing the length of a set of one or more conductors. The method 800 includes identifying 802 one or more frequencies of a wireless communication connection associated with at least one of one or more antennas 302 of a wireless communication device 100 that are affected by a set of one or more conductors 508 extending through an area 320 proximate to the at least one of the one or more antennas 302, where the set of one or more conductors 508 are part of an auxiliary electronic element 400, which is selectively coupled to the wireless communication device 100. The set of one or more conductors 508, in addition to extending through an area 320 proximate to the at least one of the one or more antennas 302 when the auxiliary electronic element 400 is coupled to the wireless communication device 100, extends from main internal circuitry of the auxiliary electronic element 400.

The method further includes determining 804 a quarter wavelength of the affected one or more frequencies, which has the longest wavelength. The length of the set of one or more conductors 508 is then adjusted 806, such that the distance between the area 320 proximate to the at least one of the one or more antennas 302 through which the set of one or more conductors 508 extends there through and the connection to the main internal circuitry is equivalent to the determined quarter wavelength.

In some embodiments, the method 800 still further includes making 808 a ground connection via a selective signal frequency shorting circuit 602, where the location 512 of the ground connection along the length of the set of one or more conductors 508 is one quarter of the wavelength of a respective shorter affected frequency measured from the area 320 proximate to the at least one of the one or more antennas 302 through which the set of one or more conductors extends toward the coupled end associated with the main internal circuitry. The number of any ground connections along the length of the set of one or more conductors via a respective selective signal frequency shorting circuit 602 is dependent upon the number of affected frequencies in addition to the affected frequency having the longest wavelength, that it is desired to try to mitigate the consequences of when the set of one or more conductors 508 of the auxiliary electronic element 400 extends through the area 320 proximate to the set of one or more antennas 302 of the wireless communication device 100, when the auxiliary electronic element 400 is coupled to the wireless communication device 100.

While the present embodiments, have been described in connection with a set of conductors 508 extending through an area 320 proximate to the one or more antennas 302 that are near a top edge of the wireless communication device 100, and which are part of a conductive housing, one skilled in the art will appreciate that the one or more antennas could be alternatively located relative to the wireless communication device and need not be part of a conductive housing without departing from the teachings of the present application. Furthermore, the set of one or more conductors need not extend beyond the footprint of the wireless communication device to have an impact through an encroachment to an area proximate to the one or more antennas. The teachings of the present application can be beneficially applied to other instances where a set of conductors of an auxiliary electronic element, such as a peripheral, can extend through an area proximate to one or more antennas of a wireless communication device, when the auxiliary electronic element is coupled to the wireless communication device.

While the preferred embodiments have been illustrated and described, it is to be understood that the application is not so limited. Numerous modifications, changes, variations, substitutions and equivalents will occur to those skilled in the art without departing from the spirit and scope of the present application as defined by the appended claims.

What is claimed is:

1. An auxiliary electronic element for coupling to a wireless communication device, the auxiliary electronic element comprising:

main internal electronic circuitry for supporting and controlling at least some of the operation of the auxiliary electronic element;

a set of one or more conductors coupled to and extending away from the main internal electronic circuitry of the auxiliary electronic element, where the set of one or more conductors extends through an area proximate to at least one of one or more antennas of the wireless communication device a predetermined adjusted length away from the main internal electronic circuitry, when the auxiliary electronic device is coupled to the wireless communication device, the at least one of one or more antennas of the wireless communication device supporting a wireless communication connection with another wireless communication device; and wherein the predetermined adjusted length of the set of one or more conductors is selected so as to match a one quarter length of a longest wavelength of one or more frequencies of the wireless communication connection associated with the at least one of the one or more antennas, which are affected by the set of one or more conductors of the auxiliary electronic element extending through the area proximate thereto.

2. An auxiliary electronic element in accordance with claim 1, further comprising additional electronic circuitry separate from the main internal electronic circuitry, where the set of one or more conductors of the auxiliary electronic element couples the separate additional electronic circuitry to the main internal electronic circuitry.

3. An auxiliary electronic element in accordance with claim 2, wherein the separate additional electronic circuitry of the auxiliary electronic element extends beyond a portion of an outline of the wireless communication device, when the auxiliary electronic element is coupled to the wireless communication device.

4. An auxiliary electronic element in accordance with claim 3, wherein the at least one of the one or more antennas of the wireless communication device is located proximate to the portion of the outline of the wireless communication device, that the separate additional electronic circuitry of the auxiliary electronic element extends beyond.

5. An auxiliary electronic element in accordance with claim 4, wherein the portion of the outline of the wireless communication device corresponds to a top of the wireless communication device.

6. An auxiliary electronic element in accordance with claim 1, wherein the auxiliary electronic element is at least one of a peripheral and an accessory.

7. An auxiliary electronic element in accordance with claim 1, wherein the set of one or more conductors is included as part of a flexible circuit substrate.

8. An auxiliary electronic element in accordance with claim 1, wherein the one or more frequencies of the wireless communication connection associated with the at least one of the one or more antennas, which are affected by the set of one or more conductors include at least a pair of affected frequencies, where a shortest wavelength of the at least pair of affected frequencies is used to determine a location of a ground connection for the set of one or more conductors, where the location of the ground connection is one quarter of the wavelength of the shortest wavelength measured from the area proximate to the at least one of the one or more antennas through which the set of one or more conductors extends, toward the coupled end associated with the internal electronic circuitry, and where the ground connection is made via a selective signal frequency shorting circuit, which is tuned to the frequency from the at least pair of affected frequencies having the shortest wavelength.

9. An auxiliary electronic element in accordance with claim 8, wherein the selective signal frequency shorting circuit appears to have a short to ground at the affected frequency having the shortest wavelength, while appearing to be an open circuit or have a high impedance at other frequencies.

10. An auxiliary electronic element in accordance with claim 8, wherein the selective signal frequency shorting circuit is a series resonant circuit.

11. An auxiliary electronic element in accordance with claim 10, wherein the series resonant circuit is an LC tank circuit.

12. An auxiliary electronic element in accordance with claim 8, wherein the selective signal frequency shorting circuit is an open transmission line stub.

13. An auxiliary electronic element in accordance with claim 1, wherein the one or more frequencies of the wireless communication connection associated with the at least one of the one or more antennas, which are affected by the set of one or more conductors include at least a pair of affected frequencies in addition to the affected frequency having the longest wavelength, where each of the shorter wavelengths of the at least pair of additional affected frequencies is used to determine a respective location of a ground connection for the set of one or more conductors, where the respective locations of the ground connections are each one quarter of the wavelength of the respective additional affected frequencies measured from the area proximate to the at least one of the one or more antennas through which the set of one or more conductors extends, toward the coupled end associated with the internal electronic circuitry, and where the ground connections are made via respective selective signal frequency shorting circuits, each tuned to the corresponding respective additional affected frequency.

14. An auxiliary electronic element in accordance with claim 13, wherein each of the respective selective signal frequency shorting circuits are tuned so as to appear to have a short to ground at the associated respective affected frequency, while appearing to be an open circuit or have a high impedance at frequencies other than the associated respective affected frequency.

15. In an auxiliary electronic element for selectively coupling to a wireless communication device, where the auxiliary electronic element includes main internal circuitry and a set of one or more conductors extending from the main internal circuitry, the set of one or more conductors also extending through an area proximate to at least one of one or more antennas of the wireless communication device, when the auxiliary electronic element is coupled to the wireless communication device, a method for managing the length of the set of one or more conductors, the method comprising:

identifying one or more frequencies of a wireless communication connection associated with the at least one of the one or more antennas that are affected by the set of one or more conductors extending through an area proximate to the at least one of the one or more antennas;

determining a quarter wavelength of the affected one or more frequencies having the longest wavelength;

adjusting the length of the set of one or more conductors, such that the distance between the area proximate to the at least one of the one or more antennas through which the set of one or more conductors extends there through and the connection to the main internal circuitry is equivalent to the determined quarter wavelength.

16. A method in accordance with claim 15, wherein the one or more identified frequencies of the wireless communication connection associated with the at least one of the one or more antennas, which are affected by the set of one or more conductors include at least a pair of affected frequencies, where a shortest wavelength of the at least pair of affected frequencies is used to determine a location of a ground connection for the set of one or more conductors, where the location of the ground connection is one quarter of the wavelength of the shortest wavelength measured from the area proximate to the at least one of the one or more antennas through which the set of one or more conductors extends toward the coupled end associated with the main internal circuitry, and where the ground connection is made via a selective signal frequency shorting circuit.

17. A method in accordance with claim 16, wherein the selective signal frequency shorting circuit is tuned so as to appear to have a short to ground at the affected frequency having the shortest wavelength, while appearing to be an open circuit or a circuit having a high impedance at other frequencies.

18. A method in accordance with claim 15, wherein the one or more identified frequencies of the wireless communication connection associated with the at least one of the one or more antennas, which are affected by the set of one or more conductors include at least a pair of additional affected frequencies, where each of the shorter wavelengths of the at least pair of additional affected frequencies are each used to determine a respective location of a ground connection for the set of one or more conductors, where the respective locations of the ground connections are each one quarter of the wavelength of the respective additional affected frequencies measured from the area proximate to the at least one of the one or more antennas through which the set of one or more conductors extends toward the coupled end associated with the main internal circuitry, and where the ground connections are each made via respective selective frequency shorting circuits.

19. A method in accordance with claim 18, wherein each of the respective selective frequency shorting circuits are tuned so as to appear to have a short to ground at the associated respective affected frequency, while appearing to be an open circuit or have a high impedance at frequencies other than the associated respective affected frequency.

20. A wireless communication device comprising:

one or more antennas for supporting a wireless communication connection with one or more other wireless communication devices via at least one of transmitter circuitry and receiver circuitry;

an electrical connection port located at a point along an external surface of the wireless communication device, the electrical connection port for selectively coupling to an auxiliary electronic element; and a coupled auxiliary electronic element including main internal electronic circuitry for supporting and controlling at least some of the operation of the coupled auxiliary electronic element;

a set of one or more conductors coupled to and extending away from the main internal electronic circuitry of the coupled auxiliary electronic element, where the set of one or more conductors extends through an area proximate to at least one of the one or more antennas of the wireless communication device a predetermined adjusted length away from the main internal electronic circuitry; and wherein the predetermined adjusted length of the set of one or more conductors is selected so as to match a one quarter length of a longest wavelength of one or more frequencies of the wireless communication connection associated with the at least one of the one or more antennas, which are affected by the set of one or more conductors of the auxiliary electronic element extending through the area proximate thereto.

* * * * *